US008166672B2

(12) United States Patent
Murphy et al.

(10) Patent No.: US 8,166,672 B2
(45) Date of Patent: May 1, 2012

(54) SHOE SOLE AND SHOE FOR MIDFOOT STRIKER

(75) Inventors: Sean Murphy, North Andover, MA (US); Matthew Pauk, Bradford, MA (US)

(73) Assignee: New Balance Athletic Shoe, Inc., Boston, MA (US)

( * ) Notice: Subject to any disclaimer, the term of this patent is extended or adjusted under 35 U.S.C. 154(b) by 686 days.

(21) Appl. No.: 12/283,097

(22) Filed: Sep. 8, 2008

(65) Prior Publication Data

US 2009/0145005 A1 Jun. 11, 2009

Related U.S. Application Data

(60) Provisional application No. 60/967,670, filed on Sep. 6, 2007.

(51) Int. Cl.

| | |
|---|---|
| ***A43B 13/18*** | (2006.01) |
| ***A43B 13/00*** | (2006.01) |
| ***A43B 13/14*** | (2006.01) |
| ***A43B 7/22*** | (2006.01) |

(52) U.S. Cl. ..... 36/28; 36/103; 36/31; 36/91

(58) Field of Classification Search ..... 36/102, 36/103, 28, 30 R, 31, 59 R, 59 C, 91
See application file for complete search history.

(56) References Cited

U.S. PATENT DOCUMENTS

| | | | | |
|---|---|---|---|---|
| 4,316,334 | A * | 2/1982 | Hunt | 36/91 |
| 2001/0032399 | A1 | 10/2001 | Litchfield | |
| 2002/0004999 | A1 * | 1/2002 | Caine et al. | 36/129 |
| 2002/0050078 | A1 * | 5/2002 | Dietrich et al. | 36/88 |
| 2002/0088144 | A1 * | 7/2002 | Katz et al. | 36/88 |
| 2002/0144431 | A1 * | 10/2002 | Knoerr | 36/31 |
| 2004/0016146 | A1 * | 1/2004 | Oman et al. | 36/29 |
| 2004/0049946 | A1 * | 3/2004 | Lucas et al. | 36/28 |
| 2005/0166425 | A1 * | 8/2005 | Seiter | 36/44 |
| 2005/0262729 | A1 * | 12/2005 | Manz et al. | 36/25 R |
| 2005/0278978 | A1 | 12/2005 | Swigart | |
| 2006/0032087 | A1 * | 2/2006 | Lacorazza et al. | 36/28 |
| 2007/0033834 | A1 * | 2/2007 | Cheskin et al. | 36/44 |
| 2008/0163513 | A1 * | 7/2008 | Chapman et al. | 36/91 |
| 2009/0049712 | A1 * | 2/2009 | Steszyn et al. | 36/91 |
| 2009/0071038 | A1 * | 3/2009 | Luthi et al. | 36/91 |

OTHER PUBLICATIONS

Written Opinion of the International Searching Authority for PCT/US2008/010529 as issued on Dec. 8, 2008.
International Search Report for PCT/US2008/010529 as issued on Dec. 8, 2008.

* cited by examiner

*Primary Examiner* — Darnell Jayne
*Assistant Examiner* — Andrew Roersma
(74) *Attorney, Agent, or Firm* — New Balance Athletic Shoe, Inc.

(57) ABSTRACT

The present invention provides an improved shoe sole for a running shoe conducive to a midfoot striking gait including a cushioning element positioned between the upper surface and the ground-contacting surface, at least a portion of which is positioned on a lateral side of the sole and contained within a region between 15% and 90% of the length of the shoe sole as measured from a rearfoot end of the sole. One or more high abrasion-resistant ground-contacting crash pads are positioned below the cushioning element, and include a lateral side portion contained within a region extending a distance of 20% the length of the shoe sole, as measured from a rearfoot end of the shoe sole. The shoe sole, preferably devoid of at least vertical arch sculpting, also includes a longitudinal flex groove positioned just medial of the crash pads.

6 Claims, 7 Drawing Sheets

60
90
65
85
80
150
100
70
95
110
140
130
120
155
= HIGH ABRASION OUTSOLE
= MIDSOLE
= OUTSOLE
CUSHIONING ELEMENT

SHOE SOLE AND SHOE FOR MIDFOOT STRIKER

CROSS-REFERENCE TO RELATED APPLICATIONS

This application claims priority to U.S. Patent Application Ser. No. 60/967,670 filed Sep. 6, 2007, the entirety of which is incorporated herein by reference thereto.

TECHNICAL FIELD

This invention relates to shoes and shoe soles which are designed for runners, in particular, for runners who make initial contact with a running surface with the midfoot during a gait cycle.

BACKGROUND

Footstrike characteristics of runners have been studied and evaluated for more than 25 years. These studies have all shown that a majority of the running population, at least 60 to 80%, naturally make initial contact with a running surface over a gait cycle with the heel. These runners are referred to as heel-to-toe runners, heel strikers, or rearfoot strikers. As shown in FIG. 1, rearfoot strikers strike the ground first with the edge of the lateral heel, within the shaded area shown as initial rearfoot strike zone 10.

In 1980, Cavanagh and Lafortune first identified another distinct footstrike pattern in a study of a group of 17 runners. Five (5) of the subjects landed initially in some area 20 of the midfoot, as shown in FIG. 2, in contrast to the remaining twelve (12) who landed on the heel area. Cavanagh, Peter R. and LaFortune, Mario A., "Ground Reaction Forces in Distance Running," *J. Biomechanics*, Vol. 13, pp. 397-406 (June 1979), (hereinafter "Cavanagh"). These five runners were identified as so-called "midfoot strikers."

In Cavanagh, the total contact area over a gait cycle was monitored for both rearfoot strikers and midfoot strikers, once these two categories of runners were identified. Cavanagh found that while the total contact area over a gait cycle for midfoot strikers was largely confined to a central portion of the lateral side of the foot, the total contact area for rearfoot strikers was larger, extending from the initial strike zone 10 in the lateral heel area to a forefoot toe portion of the foot along the longitudinal axis of the shoe in the final "toe-off" phase of the gait. The larger contact area for rearfoot strikers is indicative of the greater percentage of the gait cycle during which a rearfoot striker's foot contacts the ground. Consequently, rearfoot strikers are considered to have a less efficient running gait than midfoot strikers.

Though the midfoot striking technique appears to be superior, studies have shown that the majority of runners are naturally rearfoot strikers. In 1983, for example, in a study of the footstrike characteristics of both recreational runners participating in a 10 k event and elite runners participating in a marathon, it was found that approximately 80% of the runners in each of the events landed on the heel and 20% landed on the midfoot. It was also found, however, that the faster runners in each event tended to be midfoot strikers. Kerr, B. A., Beauchamp, L., Fisher, V. and Neil, R., "Footstrike Patterns in Distance Running," *Biomechanical Aspects of Sports Shoes and Playing Surfaces*, pp. 135-142 (University Printing Calgary, Calgary A B, 1983).

Other studies have also suggested a correlation between speed and running gait. For example, it has been found that a great number of runners who may appear to be heel strikers at a comfortable running pace, change to a midfoot striking gait at increased speeds, largely due to an involuntarily shift forward of body weight. Williams, Keith R., "Biomechanics of Running," *Exercise and Sport Sciences Reviews*, Vol. 13, pp. 299-441 (1985).

Serious runners have become increasingly aware of the advantages of implementing a midfoot striking gait as outlined in these and other studies. These advantages include reduced incidences of injury in addition to increased speed and efficiency. McClay, I. and Williams, D., "Lower Extremity Mechanics in a Converted Forefoot Strike pattern in Runners," *North American Congress on Biomechanics*, Waterloo, Canada (Aug. 14-18, 1998). Consequently, many runners have converted or attempted to convert from their natural rearfoot striking gait to this midfoot striking technique.

Nicholas Romanov, who developed a now well-known technique of running trademarked as POSE®, has been one of the strongest advocates for teaching this midfoot striking running technique as the preferred running gait. Romanov's technique requires the runner to land on the midfoot, with the supporting joints flexed at impact, and to then use the hamstring muscles to withdraw the foot from the ground, relying on gravity to propel the runner forward. In addition to outlining the technique, Romanov also developed a roadmap of exercises for how a runner could convert from the typical heel strike running pattern to the POSE® running technique. Arendse, R. E, Noakes, T. D., Romanov, N., Schwellnus, M. P., and Fletcher, G., "Reduced Eccentric Loading of the Knee with the Pose Running Method," *Medicine & Science in Sports & Exercise*, Vol. 36(2), pp. 272-277 (February 2004).

Midfoot strikers, therefore, fall into the following three basic categories: those that inherently employ a midfoot striking gait independent of speed; runners that are rearfoot strikers at a comfortable running pace, but naturally shift to midfoot or even forefront striking as their speed increases; and those that are inherently rearfoot strikers but have converted or are trying to convert to a midfoot striking gait for various reasons.

Though there have been some attempts in the footwear industry to fashion a shoe that is conducive to midfoot striking, there is a need for an improved running shoe for both natural and converted midfoot strikers.

SUMMARY OF THE INVENTION

The present invention provides an improved shoe sole for a running shoe conducive to a midfoot striking gait and a shoe including an upper and the shoe sole.

The shoe sole for a running shoe includes an upper surface; a ground-contacting surface; and a cushioning element positioned between the upper surface and the ground-contacting surface. At least a portion of the cushioning element is positioned on a lateral side in a midfoot region of the shoe sole. The lateral portion is contained within a region between 20% and 90% of the length of the shoe sole as measured from a rearfoot end of the shoe sole.

The shoe sole also includes one or more ground-contacting crash pads positioned below the cushioning element. The one or more ground-contacting crash pads have a lateral portion contained within a region extending from 15% of the length of the shoe sole as measured from the rearfoot end of the shoe sole to the rearfoot end. The lateral portion of the ground-contacting surface includes a lower surface of the one or more ground-contacting crash pads.

The shoe sole also includes a longitudinal flex groove positioned just medial of the lateral portion of the one or more ground-contacting crash pads.

In one aspect, the cushioning element is positioned only on the lateral side within a region located between 20% and 70% of the length of the shoe sole as measured from the rearfoot end.

In another aspect, the cushioning element further includes a medially extended portion in a forefoot region which covers the metatarsal head area of the foot.

Preferably, the shoe sole is devoid at least of vertical sculpting in a lateral arch area. In one aspect, there is no sculpting, vertical or horizontal.

The shoe sole can include a midsole layer. The midsole layer can be positioned either above or below the cushioning element, or the cushioning element can be sandwiched between midsole layers.

In one aspect, a difference in thickness between the midsole layer in a rearfoot region and that in a forefoot region is less than 10 mm.

In one aspect of a shoe sole of the present invention, one or more ground-contacting crash pads is located solely on the lateral side, and is contained within a region on the lateral side between 20% and 70% of the length of the shoe sole as measured from the rearfoot end.

The one or more ground-contacting crash pads can include at least one of a high abrasion-resistant engineered rubber, a foam rubber, and a sticky blown rubber.

In another aspect, the longitudinal flex groove extends over between 80% and 90% of the length of the shoe sole.

A shoe of the present invention includes the shoe sole of the present invention and an upper positioned above the shoe sole. In one aspect, the upper can include a lateral stabilizer positioned in a forefoot region of the shoe.

Another shoe sole for a running shoe of the present invention includes an upper surface, a ground-contacting surface, and a cushioning element positioned between the upper surface and the ground-contacting surface. At least a portion of the cushioning element is positioned on a lateral side in a midfoot region of the shoe sole and contained within a region between 15%, preferably 20%, and 90% of the length of the shoe sole as measured from a rearfoot end of the sole.

The shoe sole can also include one or more ground-contacting crash pads positioned on a lower surface of the cushioning element on the lateral side of the shoe sole and preferably contained within a region between 20% and 70% of the length of the shoe sole, as measured from a rearfoot end of the shoe sole. Accordingly, a portion of the ground-contacting surface includes a lower surface of the one or more ground-contacting crash pads.

The shoe sole also includes a longitudinal flex groove positioned just medial of the one or more ground-contacting crash pads and which can extend over between 80% and 90% of the length of the shoe sole.

BRIEF DESCRIPTION OF THE DRAWINGS

FIG. 4A is a side view of the embodiment and FIG. 4B is a bottom view of the embodiment.

FIG. 5A is a side view of this embodiment and FIG. 5B is a bottom view of this embodiment.

DETAILED DESCRIPTION

The present invention, which provides an improved shoe sole for a running shoe and a running shoe conducive to a midfoot striking gait, can be better understood from the following description of preferred embodiments, taken in conjunction with the accompanying drawings. It should be apparent to those skilled in the art that the described embodiments of the present invention provided herein are merely exemplary and illustrative and not limiting. All features disclosed in the description may be replaced by alternative features serving the same or similar purpose, unless expressly stated otherwise. Therefore, numerous other embodiments of the modifications thereof are contemplated as falling within the scope of the present invention and equivalents thereto.

It should be noted that the as used herein, the term "midfoot strikers" and "midfoot striking" are intended to also encompass the class of runners often referred to in the prior art as "toe strikers."

Figure 2:
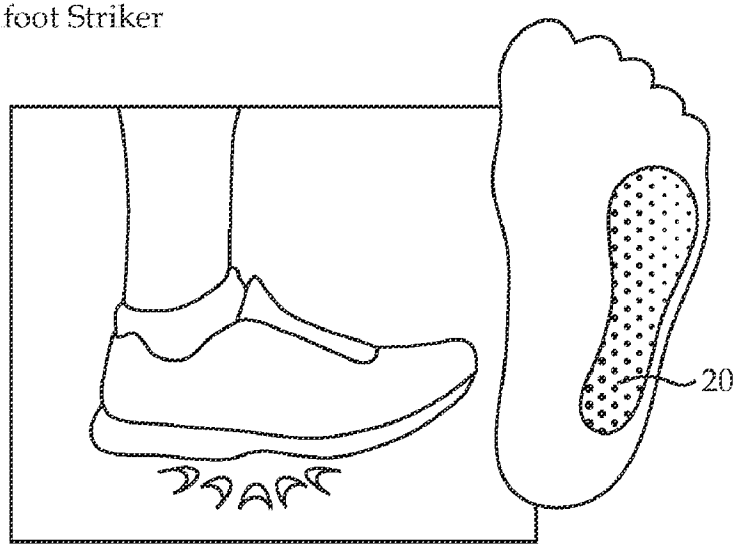
FIG. 2 PRIOR ART
FIG. 2 is a schematic representation of the initial strike action of a midfoot striker.
Figure 1:
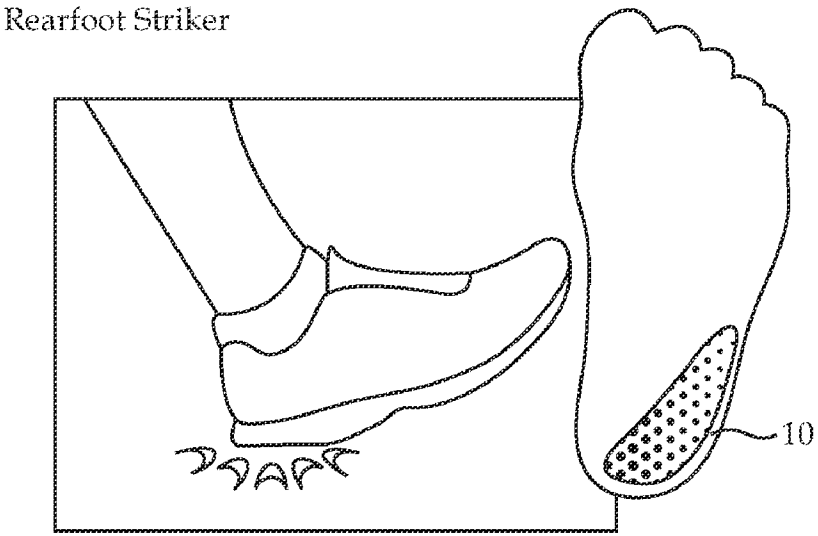
FIG. 1 PRIOR ART
FIG. 1 is a schematic representation of the initial strike action of a rearfoot striker.
Figure 3B:
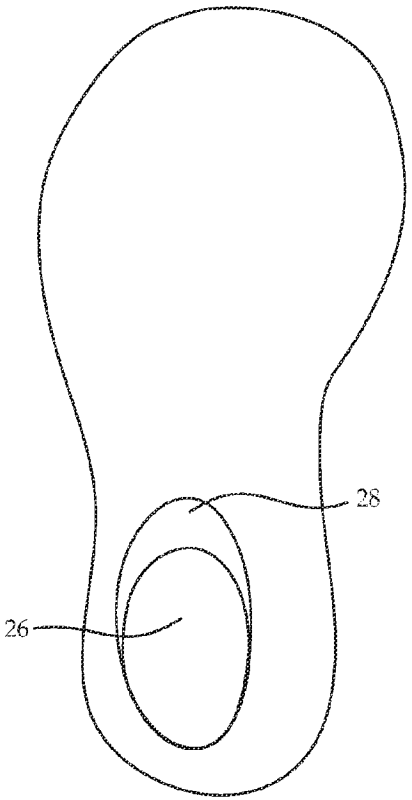
FIG. 3B PRIOR ART
FIG. 3B is schematic representation of pressure distribution for a typical rearfoot striker for the initial impact phase of a running gait cycle.
Figure 3A:
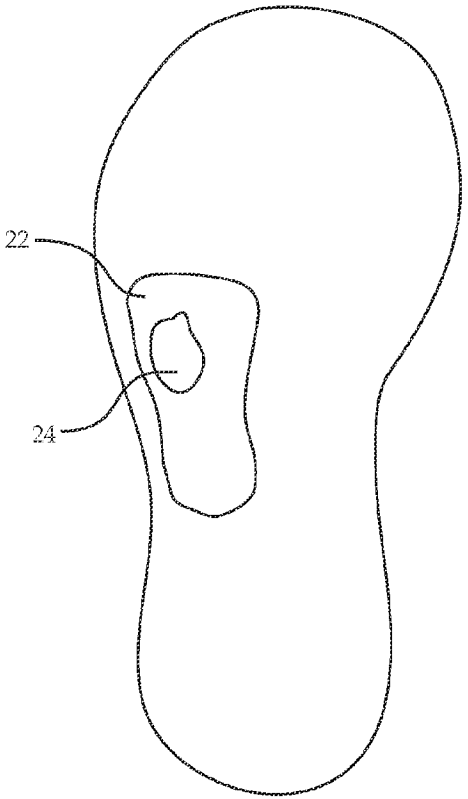
FIG. 3A PRIOR ART
FIG. 3A is schematic representation of pressure distribution for a typical midfoot striker for the initial impact phase of a running gait cycle.

As shown in FIGS. 3A and 3B, runners with a midfoot striking gait distribute pressure across the foot during a running gait cycle differently than the majority of runners who employ a rearfoot striking gait. This is particularly evident from the point of initial impact, phase 1, to the so-called "midstance" or transition phase, phase 2, of a running gait cycle. In particular, there is a smaller total area 22 of ground contact in the midfoot striking gait, with the highest pressure zone 24 occurring in the lateral midfoot region, as opposed to a typical highest pressure zone 26 within a total area 28 of ground contact in the heel region of the rearfoot striker. The pressure distribution during phase 3, the "toe-off" phase is substantially the same for midfoot and rearfoot strikers.

Figure 3C:
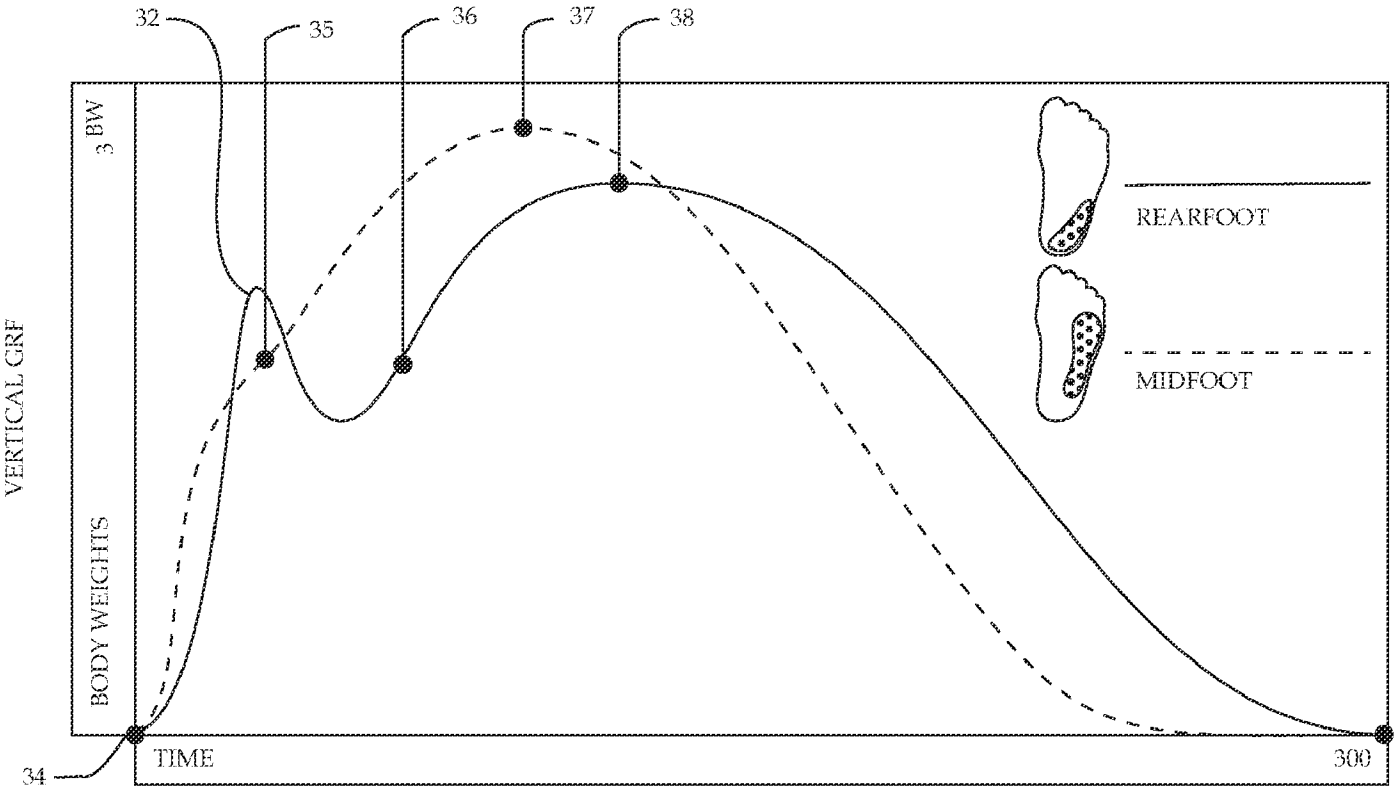
FIG. 3C PRIOR ART
FIG. 3C is a plot of ground reaction forces typical of rearfoot strikers compared with midfoot strikers over a running gait cycle.

In a study conducted by the inventors, differences between the running gait cycle for rearfoot strikers (RFS) and midfoot strikers (MFS) was examined in more detail. FIG. 3C provides a plot of ground reaction forces (the forces exerted from the foot in the x, y, or z axis) throughout the running gait cycle for these two types of runners. In this study, phase 3 was further broken down into separate push-off (active) and toe-off phases.

Notably, the spike 32 in ground reaction forces just after initial impact 34 in rearfoot strikers, which occurs in the heel region, is absent in midfoot strikers. This distinguishing feature affects the amount of cushioning that is needed in various areas of a shoe sole conducive to midfoot strikers.

As shown in FIG. 3C, the study also found that the change in the vertical ground reaction forces is greater between the weight shift or midstance phase 35 and the push-off phase 37 for the midfoot striker than it is between the midstance phase 36 and push-off phase 38 for the rearfoot striker. In addition, the study determined that midfoot and so-called "toe strikers," another category that is used by some to distinguish between midfoot-striking and more forward toe-striking, are not really distinguishable in that midfoot strikers will shift more forward to the toe area as their speed increases. As used herein, therefore, the term "midfoot strikers" and "midfoot striking" are intended to encompasses the class of runners often referred to in the prior art as toe strikers.

Figure 3E:
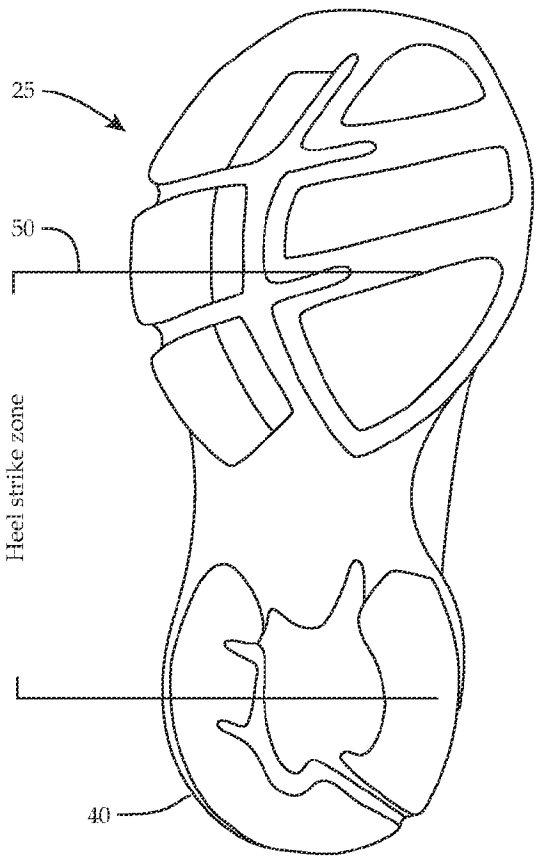
FIG. 3E PRIOR ART
FIG. 3E is a bottom view of a typical running shoe designed for a rearfoot striker with a lengthwise strike zone of a midfoot striker indicated.
Figure 3D:
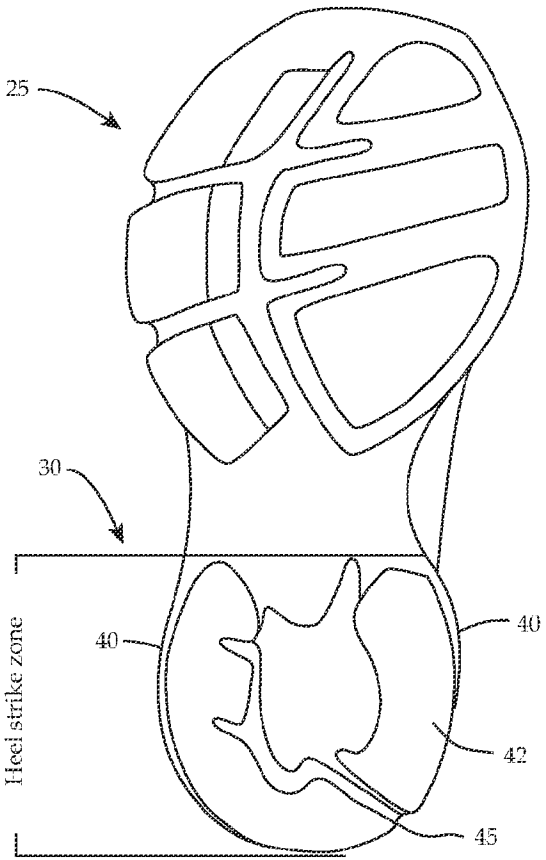
FIG. 3D PRIOR ART
FIG. 3D is a bottom view of a typical running shoe designed for a rearfoot striker with a lengthwise strike zone of a rearfoot striker indicated.

Referring to FIGS. 3D and 3E, a conventional running shoe 25 is designed to cushion the initial impact of a running gait that begins with an initial heel strike of a rearfoot striker that occurs within a heel strike zone 30. Accordingly, the conventional running shoe 25 shown in FIGS. 3D and 3E, for example, includes high-impact cushioning pads 40 appropriately positioned above an outsole 42 and within the heel strike zone 30 on both a medial and lateral side of the shoe 25 to cover the most common areas of initial impact characteristic of most rearfoot strikers. In addition, the running shoe 25 includes a heel cleft 45 which is placed on the medial side of the shoe, medial to the most common point of heel strike in rearfoot strikers, in order to allow the sole to bend at impact thereby reducing pronation velocity.

In contrast, a running shoe of the present invention includes cushioning and ground-contacting crash pads appropriately positioned within midfoot strike zone 50 to cover the most common areas of initial impact characteristic of most midfoot strikers, and a longitudinal flex groove appropriately positioned closer to the central longitudinal axis of a shoe to reduce pronation velocity in midfoot strikers.

In studies performed on numerous subjects, the inventors have determined that the initial strike for the majority of the midfoot striking population can occur anywhere in the lateral midfoot region between about 20% to about 70% of the length of a shoe sole as measured from a rearfoot end.

Therefore, to provide the necessary cushioning and support throughout the midfoot gait cycle of a midfoot striker, at least a portion of a cushioning element of the present invention is positioned on a lateral side in a midfoot region of the shoe sole and contained within a region between 15%, preferably 20%, and 90% of the length of the shoe sole as measured from a rearfoot end of the sole.

In addition, the "crash pad" is preferably located on the lateral side at least within this 20-70% zone to accommodate initial strike. To provide additional support at initial impact, therefore, the one or more crash pads of the invention are positioned below the cushioning element to form a portion of the ground-contacting surface on the lateral side of the shoe sole and positioned at least within a region between 20%, and 70%, of the length of the shoe sole as measured from a rearfoot end of the sole.

The width of a crash pad of the present invention is preferably less than half the transverse width of the sole, most preferably, 30% or less than the transverse width.

Figures 4A, 4B:
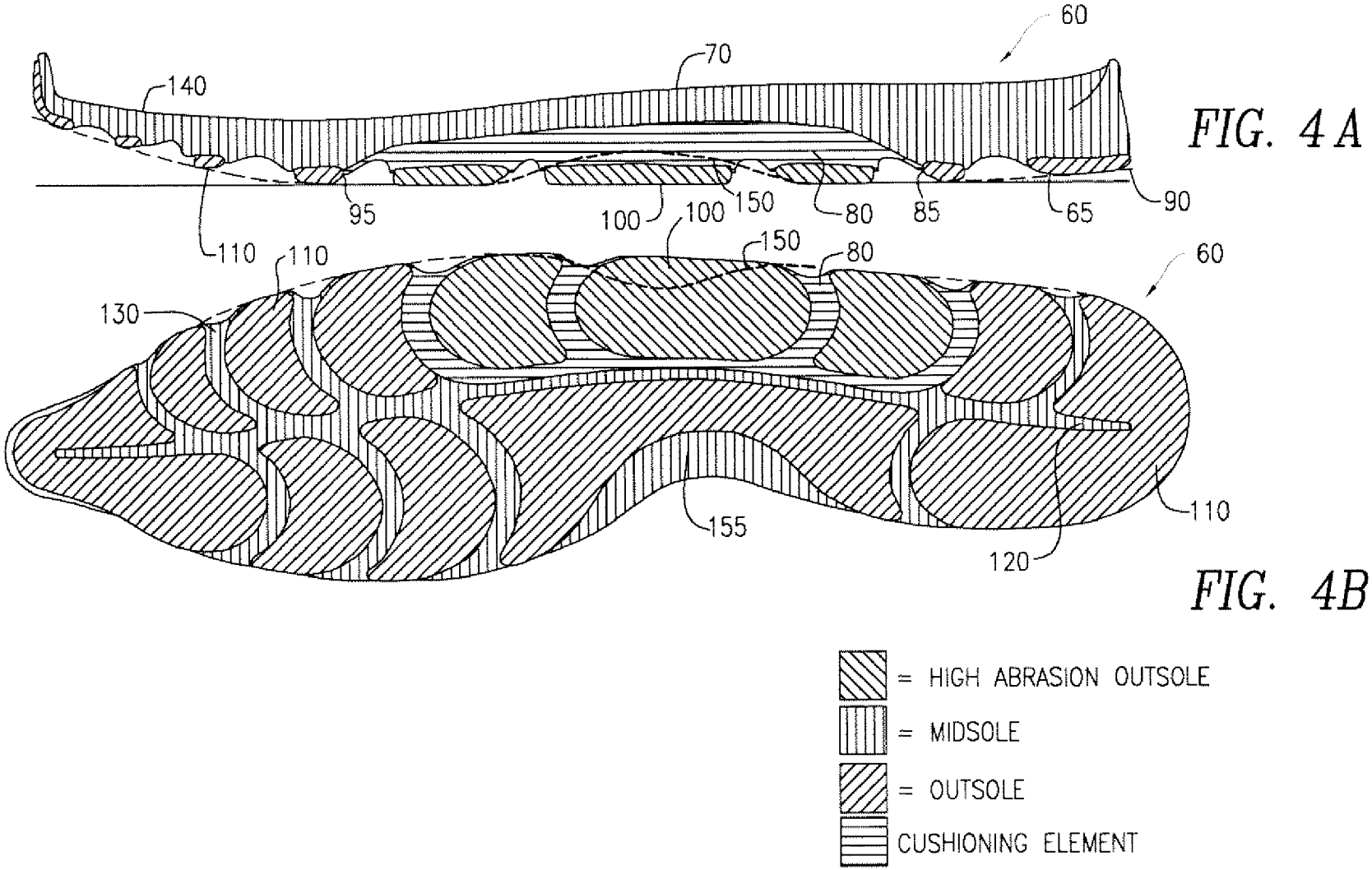
FIGS. 4A and 4B are representations of an embodiment of a shoe sole for a running shoe of the present invention.

In particular, referring to FIGS. 4A and 4B, one embodiment of a sole 60 for a running shoe in accordance with the present invention includes a ground-contacting lower surface 65, an upper surface 70 proximate an insole (not shown), a high-impact cushioning element 80, and one or more crash pads 100. The cushioning element 80 shown in FIGS. 4A and 4B is positioned between the lower surface 65 and upper surface 70 of the sole 60, and only on the lateral side of the sole 60.

Cushioning element 80 has a first end 85 positioned a distance from a rearfoot end 90 of the sole equal to at least 15%, preferably at least 20%, of the entire length of the sole 60, and preferably not more than 50%. A second end 95 of the cushioning element 80 is at a distance from the rearfoot end 90 which is between about 60% and about 80% inclusive of the entire length of the sole 60, and preferably between about 60 and 70%.

The width of the cushioning element 80 is equal to or less than half the width of the shoe sole 60, and its total length is preferably equal to from 25% to 65% of the entire length of the sole 60.

A cushioning element of the present invention can include any structure and material designed to absorb impact forces as known to those of ordinary skill in the art, such as any one or combination of: cushioning or shock absorbing foams, such as New Balance's ABZORB® cushioning systems; air cushions or bladders; or shock absorbing struts made, e.g., from TPU, such as New Balance's Zip® cushioning systems.

Still referring to FIGS. 4A and 4B, the crash pad or pads 100 are shaped and positioned to provide a rugged high abrasion-resistant ground-contacting surface only under the cushioning element 80. One (1) to five (5) crash pads 100, and preferably 1 to 3 crash pads can be provided.

The crash pads of the present invention preferably include a high abrasion-resistant ground-contacting surface, for example, a high abrasion-resistant engineered rubber or foam rubber. The crash pads of the present invention may include a sticky blown rubber.

The remaining portion of ground-contacting surface 65 is provided by an outsole layer 110. The outsole layer of the present invention can be of any material and construction suitable for use as an outsole. Preferably, the outsole layer includes a thin lightweight rubber or plastic.

The ground-contacting surface of the outsole of the present invention can also include beveled treads on the side walls as well as in the heel region.

The sole 60 can also include a longitudinal flex groove 120 that separates the laterally positioned crash pads 100 from the medial side of the outsole layer 110. Preferably, the longitudinal flex groove of the present invention extends at least 80% of the length of the shoe sole, and may extend over 90% of the length.

The flex groove 120 is preferably centered between the medial and lateral sides in the midfoot or arch region of the shoe and extends rearwardly along a longitudinal direction that it is medial to the point of foot contact of midfoot-striking runners. This positioning of the flex groove ensures that it will bend on impact for any midfoot-striking gait.

Additional transverse flex grooves 130 may also be included, particularly in the forefoot region, for added flexibility over an entire gait cycle.

Referring again to FIGS. 4A and 4B, the sole 60 also preferably includes a midsole layer 140, which extends the length and width of the shoe and is positioned above outsole layer 110. The midsole layer of the present invention can include any material suitable for use as a midsole, such as EVA.

The midsole layer 140 shown in FIGS. 4A and 4B is positioned above the cushioning element 80, however, other embodiments can include a midsole layer positioned below cushioning element 80, or the cushioning element 80 sandwiched between midsole layers.

A dotted line 150 in FIGS. 4A and 4B is provided to indicate the boundaries of a conventional running shoe having a sculpted arch. Such sculpting is commonly used for lightweighting. In contrast, the sole of the present invention, which is designed to be conducive to a midfoot striking gait, has no vertical arch sculpting on the lateral side of the shoe in the arch region. Preferably, the sole also has no horizontal arch sculpting on the lateral side.

Without this sculpting, the sole of the present invention advantageously provides more contact area within the initial impact zone of a typical midfoot striker to prevent the sole from collapsing from continuous striking in this lateral midfoot area of the sole. The resultant flat lateral profile, therefore, provides improved ground contact and support for a midfoot-striking gait. As shown in FIG. 4B, the shoe sole of the present invention can optionally include some sculpting 155 on the medial side for lightweighting.

Figures 5A, 5B:
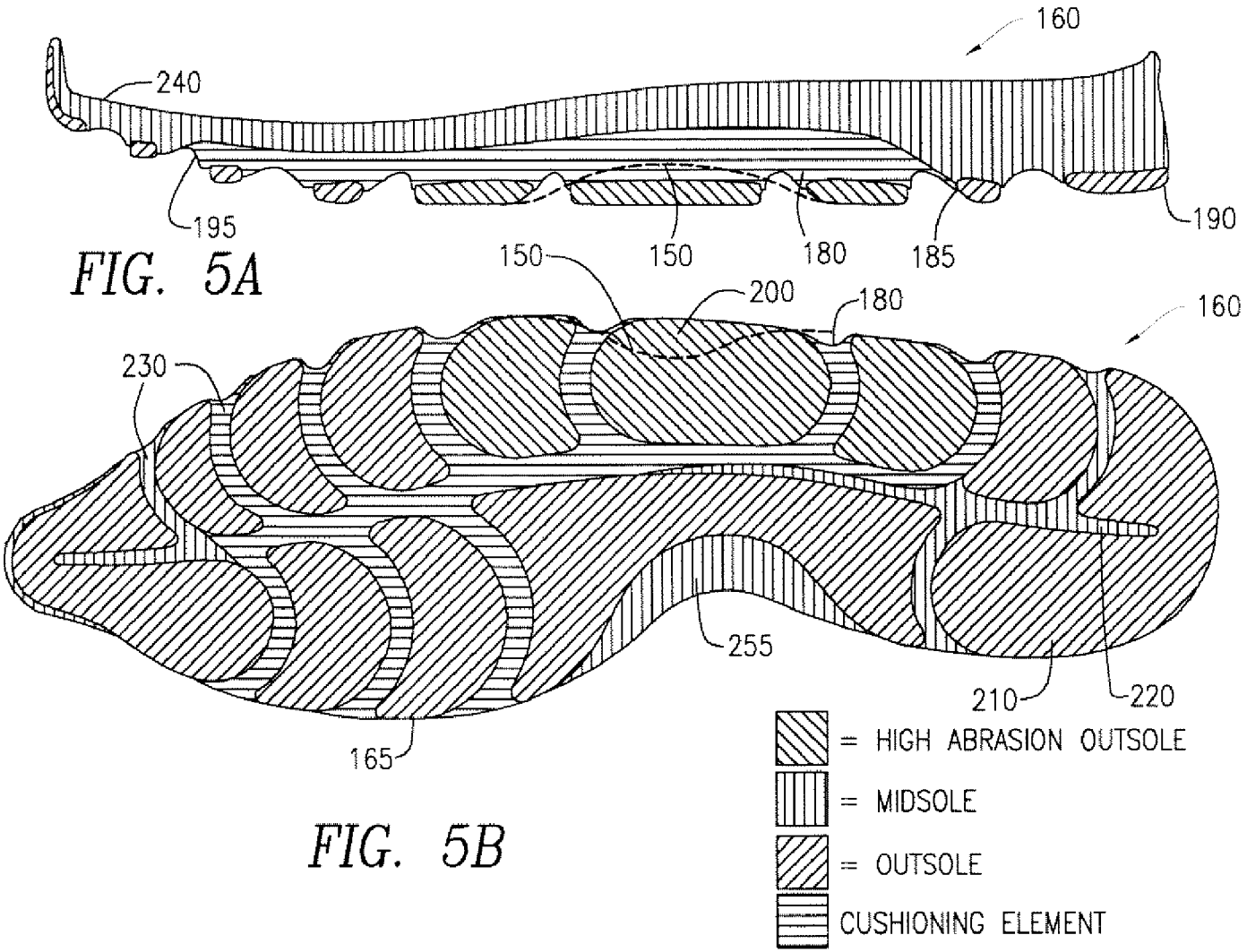
FIGS. 5A and 5B are representations of another embodiment of a shoe sole for a running shoe of the present invention.

Referring now to FIGS. 5A and 5B, another embodiment of a shoe sole 160 of the present invention includes a cushioning element 180 that extends further into the forefoot area and crosses over onto the medial side to cover the metatarsal head area of the foot. The sole 160 includes crash pads 200 positioned directly under only a portion of this cushioning element 180 on the lateral midfoot region of the shoe and contained within a region between 15%, preferably 20%, and 80%, preferably 70%, of the length of the shoe sole, as measured from a rearfoot end of the shoe sole. The remaining portion of ground-contacting surface 165 is provided by an outsole layer 210.

The cushioning element 180 extends beyond the crash pads 200, terminating a distance from the rearfoot end 190 equal to 70 to 90% of the length of the shoe sole. In this embodiment, the cushioning element 180 also extends across the width of the sole 160 in the forefoot region to provide additional cushioning in the metatarsal head area of the foot. Providing high impact cushioning in this forefoot region accommodates the forward shift in the impact strike zone that occurs as the speed of typical midfoot strikers increases.

Referring still to FIGS. 5A and 5B, the sole 160 also preferably includes a midsole layer 240, which extends the length and width of the shoe and is positioned above outsole layer 210. In one embodiment shown in FIGS. 5A and 5B, cushioning element 180 is positioned below the midsole layer 240. The sole 160 further includes a longitudinal flex groove 220 that separates the laterally positioned crash pads 200 from the medial side of the outsole layer 210, and optional transverse flex grooves 230. Preferably, the longitudinal flex groove of the present invention extends at least 80% of the length of the shoe sole, and may extend over 90% of the length. Preferably, the sole 160 includes no vertical sculpting on the lateral side of the shoe sole 160. Optionally, the sole 160 includes sculpting 255 in the medial arch region and may also include horizontal sculpting on the lateral side.

In conventional running shoes designed for a rearfoot striking gait, substantial cushioning is provided by adding thickness to a midsole layer in the heel region, which provides lift to the heel region. This lift can be provided by incorporating a separate cushioning heel wedge positioned over or under a midsole layer, or by simply providing a wedged midsole, which is thicker in the heel region. Typically, the difference in thickness in the heel relative to the forefoot region is about 10-14 mm. For example, a typical midsole thickness in the heel is 22 to 27 mm, and about 12 to 14 mm in the forefoot.

Because rearfoot strikers will not likely strike the heel region upon initial impact at the beginning of a running gait cycle, such heavy cushioning is not needed in the sole of the present invention. Accordingly, the sole of the present invention preferably includes a midsole with a difference in thickness of 5-10 mm between forefoot and heel. In one embodiment, a thickness of the midsole in the heel region is about 13-18 mm. These reduced requirements for midsole cushioning in the heel region result in a flatter, significantly lighter running shoe compared to conventional running shoes.

Figure 6A:
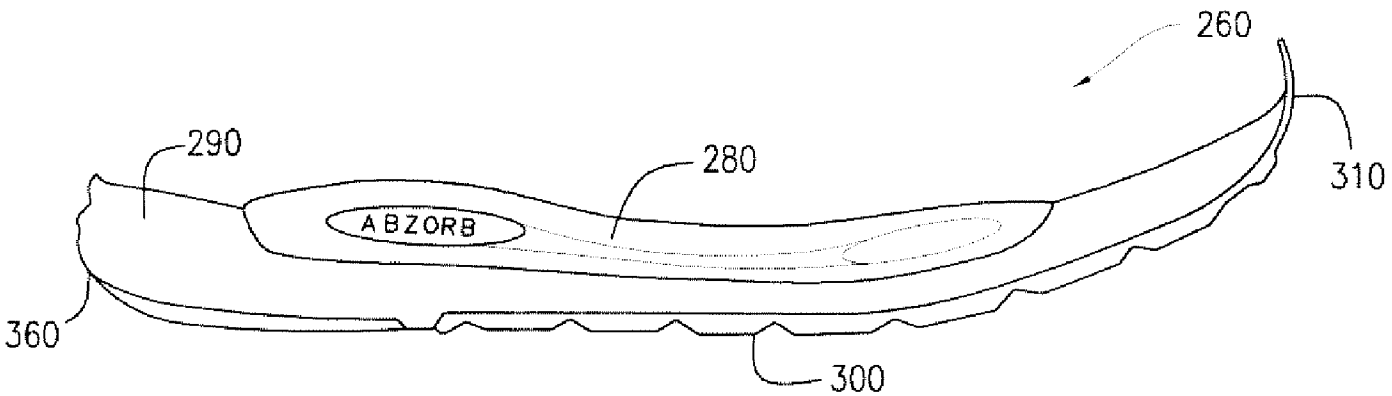
FIGS. 6A and 6B are a lateral side view and a bottom view respectively of another embodiment of a shoe sole of the present invention.
Figure 6B:
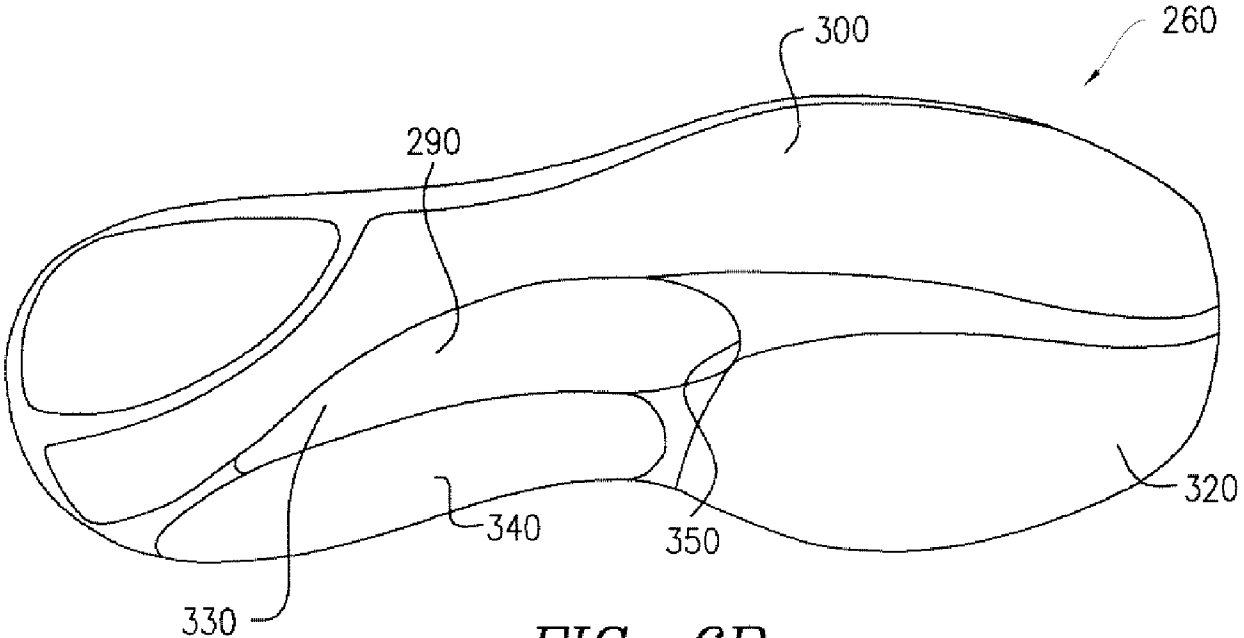

In another embodiment of a sole 260 of the present invention shown in FIGS. 6A and 6B, a cushioning element 280 of a shock-absorbing foam is positioned over a midsole layer 290 of EVA. The cushioning element 280 is positioned only on the lateral side of the sole 260 and is contained within a region beginning at a distance between about 15% and 20% to about between 75% and 80% of the length of the shoe sole, as measured from a rearfoot end of the shoe sole.

The sole 260 includes a crash pad 300, preferably made of sticky blown rubber. A lateral portion of the crash pad 300 extends rearwardly from a toe end 310 over 75 to 80% the length of the sole 260. A medial crash pad 320 is also provided to cover the medial forefoot region.

The sole 260 also includes a longitudinal flex groove 330 that separates the laterally positioned crash pad 300 from the medial side of an outsole layer 340. The longitudinal flex groove 330 extends rearward from the end 350 of the forefoot region to a point located a distance between about 15% to 20% the length of the shoe sole, as measured from the rearfoot end 360, following the inner edge of the lateral portion of the crash pad 300.

A shoe of the present invention includes an upper and an embodiment of the sole of the present invention, for example, sole 60 shown in FIGS. 4A and 4B and as described in reference thereto, or sole 160 shown in 5A and 5B and as described in reference thereto, or sole 260 shown in FIGS. 6A and 6B and as described in reference thereto. In a preferred embodiment, the upper includes a lateral support member appropriately positioned over the midfoot region and/or in the forefoot region. Such support can be provided by any appropriately positioned device or material known to provide lateral foot support for supination control.

Although illustrative embodiments of the present invention have been described herein with reference to the accompanying drawings, it is to be understood that the invention is not limited to those precise embodiments, and that various other changes and modifications may be applied therein by one skilled in the art without departing from the scope or spirit of the invention.

What is claimed is:

1. A shoe sole for a running shoe, comprising:

a midsole layer extending a length and width of the shoe sole and comprising an upper surface positionable proximate an insole and a lower surface;

a unitary cushioning element positioned below and abutting a midfoot region of the lower surface of the midsole layer on a lateral side of the shoe sole, wherein a width of the unitary cushioning element is no more than half a transverse width of the shoe sole and wherein at least a portion of the cushioning element is positioned within a region between 20% and 90% of the length of said shoe sole as measured from a rearfoot end of said shoe sole;

a ground-contacting surface comprising:

(a) one or more crash pads positioned below the cushioning element, the width of the one or more crash pads being less than half the transverse width of the shoe sole; and (b) an outsole layer positioned below and abutting the lower surface of the midsole layer over at least a portion of the heel region, the forefoot region, and a medial side of the midfoot region of the shoe sole; and a longitudinal flex groove, the flex groove separating the one or more crash pads from a medial side portion of the outsole layer.

2. The shoe sole of claim 1, wherein the cushioning element is positioned only on said lateral side within a region located between 20% and 70% of the length of said shoe sole as measured from said rearfoot end.

3. The shoe sole of claim 1, wherein the cushioning element further includes a medially extended portion in a forefoot region which covers the metatarsal head area of the foot.

4. The shoe sole of claim 1, wherein a difference in thickness between the midsole layer in a rearfoot region and that in a forefoot region is less than 10 mm.

5. The shoe sole of claim 1, wherein the longitudinal flex groove extends over between 80% and 90% of the length of the shoe sole.

6. The shoe sole of claim 1, wherein the one or more ground-contacting crash pads comprise at least one of a high abrasion-resistant engineered rubber, a foam rubber, and a sticky blown rubber.

* * * * *